US006426700B1

(12) United States Patent
Lian et al.

(10) Patent No.: US 6,426,700 B1
(45) Date of Patent: Jul. 30, 2002

(54) BIAS CONFIGURATION FOR A MAGNETOMECHANICAL EAS MARKER

(75) Inventors: Ming-Ren Lian; Hubert A. Patterson, both of Palm Beach County; Larry Burgess, Broward County, all of FL (US)

(73) Assignee: Sensormatic Electronics Corporation, Boca Raton, FL (US)

( * ) Notice: Subject to any disclaimer, the term of this patent is extended or adjusted under 35 U.S.C. 154(b) by 0 days.

(21) Appl. No.: 09/584,559

(22) Filed: May 31, 2000

(51) Int. Cl.[7] ..... G08B 13/14

(52) U.S. Cl. ..... 340/572.6; 340/572.4; 340/572.5; 340/572.7; 340/572.8

(58) Field of Search ..... 340/572.6, 572.5, 340/572.4, 572.8

(56) References Cited

U.S. PATENT DOCUMENTS 4,510,489 A 4/1985 Anderson et al. ..... 340/572
4,727,360 A * 2/1988 Ferguson et al. ..... 340/572.2
4,799,045 A * 1/1989 Fearon et al. ..... 340/572.2
4,882,569 A 11/1989 Dey ..... 340/572
5,414,412 A * 5/1995 Lian ..... 340/572.2
5,565,849 A 10/1996 Ho et al. ..... 340/572
5,568,125 A 10/1996 Liu ..... 340/551

FOREIGN PATENT DOCUMENTS

DE 29823167 U1 4/1999 ..... G08B/13/22

* cited by examiner

*Primary Examiner*—Daniel J. Wu
*Assistant Examiner*—Son Tang
(74) *Attorney, Agent, or Firm*—Rick F. Comoglio; Paul T. Kashimba

(57) ABSTRACT

A flat magnetomechanical electronic article surveillance marker is provided having a magnetostrictive resonator and a pair of bias magnets disposed on opposite sides and adjacent the resonator to bias the resonator with a magnetic field of a preselected field strength. The pair of bias magnets and the resonator are maintained substantially parallel and coplanar with each other to form a thin, flat EAS marker. During assembly of the marker, the bias magnets can be laterally adjustable to fine-tune the resonant frequency of the marker, and to compensate for material variability. Alternately, during assembly of the marker, the bias magnets can be adjustable in length to fine-tune the resonant frequency of the marker, and to compensate for material variability.

16 Claims, 17 Drawing Sheets

BIAS CONFIGURATION FOR A MAGNETOMECHANICAL EAS MARKER

CROSS REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

This invention relates to electronic article surveillance (EAS) systems, and markers and labels for use therein, and more particularly to a new bias configuration for magnetomechanical and magnetoacoustic EAS markers.

2. Description of the Related Art

U.S. Pat. No. 4,510,489, the '489 patent, discloses an EAS marker made of an elongated strip of magnetostrictive ferromagnetic material disposed adjacent to a ferromagnetic element that, when magnetized, magnetically biases the strip and arms it to resonate mechanically at a preselected resonant frequency. The marker resonates when subjected to an interrogation field at a frequency at or near the marker's resonant frequency. The response of the marker at the marker's resonant frequency can be detected by EAS receiving equipment, thus providing an electronic marker for use in EAS systems. As used herein, the term "marker" refers to markers, labels, and tags used in EAS systems.

Referring to FIG. 1, the marker of the '489 patent is constructed of a resonator, an elongated ductile strip of magnetostrictive ferromagnetic material 18, disposed adjacent a ferromagnetic element 44. Element 44 is a high coercivity biasing magnet that, when magnetized, is capable of applying a DC magnetic field to resonator 18 such that resonator 18 is provided with a single pair of magnetic poles, each of the poles being at opposite extremes of the long dimension of resonator 18. Resonator 18 is placed within the hollow recess or cavity 60 of housing 62 with bias 44 held in a parallel adjacent plane so that bias 44 does not cause mechanical interference with the vibration of resonator 18. Because resonator 18 must vibrate freely within cavity 60 and bias 44 is maintained in a parallel adjacent plane, the marker has a required minimum thickness to accommodate the adjacent parallel planes and permit free vibration of resonator 18.

Due to the close proximity of bias 44 and resonator 18, a substantial magnetic attraction exists between the resonator and the bias. The magnetic attraction causes the resonator to be pulled within its cavity toward the bias, and into a bias field region that may be slightly different than the desired bias field disposed near the center of the cavity. The magnetic attraction results in a significant loss of signal amplitude from mechanical friction between the resonator and its cavity, and from the bias instability due to the position of the resonator. To overcome the magnetic "clamping" or damping of the free vibrations of the resonator, the resonator can be annealed with a transverse curl to minimize the magnetic attraction. As a result of the curled resonator, the marker cavity must be made deeper for the resonator to vibrate freely. An even thicker marker results from the deeper cavity required to accommodate the curled resonator. U.S. Pat. No. 5,568,125 discloses a process for making a resonator with a transverse curl.

There are presently EAS marker applications in which a flat marker is desired. A flat EAS marker is defined herein as an EAS marker of lower minimum thickness than is required to accommodate a bias and a resonator that are maintained in parallel adjacent planes as illustrated in FIG. 1. A flat marker can provide a larger surface area for the attachment of indicia, and may be more bendable.

Referring to FIGS. 2 and 3, U.S. Pat. No. 4,727,360, the '360 patent, discloses a flat marker in which the resonator 48 and bias 50 are configured in a side-by-side relationship separated by a preselected distance "d", and disposed within the same plane as shown in FIG. 3. Unlike the marker disclosed in the '489 patent and described above, the marker of the '360 patent is a frequency-dividing marker. The frequency dividing marker of the '360 patent has a resonant frequency "f", which when subjected to an interrogation frequency of "2f" responds with a subharmonic of the frequency "2f".

Referring to FIGS. 4 and 5, U.S. Pat. No. 5,414,412, the '412 patent, discloses a frequency-dividing marker that is an improvement to the marker disclosed in the '360 patent. The marker disclosed in the '412 patent includes a tripole bias magnet 54 disposed adjacent resonator 52 and on the opposite side from bias 51, all of which are disposed in the same plane, to achieve improved frequency-dividing performance.

As discussed above, the markers of the '360 and '412 patents are frequency-dividing markers that do not operate in the same manner as the marker disclosed in the '489 patent. However, if a similar bias orientation, one that is positioned to the side of the resonator and in the same plane, is used in a marker of the type disclosed in the '489 patent to produce a flat magnetomechanical label, problems result. Having a single bias disposed to the side of the resonator results in a relatively lower magnetic coupling and requires an increased minimum amount of bias material to properly bias the resonator. Magnetic clamping thus results between the resonator and the larger bias. As described above, the magnetic clamping is due to magnetic attraction between the bias and the resonator that results in a "clamping" or damping of the free vibrations of the resonator thereby reducing the amplitude of the resonator's response at its preselected resonant frequency. In addition, a single bias disposed to the side of the resonator of sufficient size to properly bias the resonator results in a thick and/or wide bias that tends to demagnetize itself. The demagnetizing effect of the bias causes deterioration in the stability of the label over time.

BRIEF SUMMARY OF THE INVENTION

The present invention is a magnetomechanical electronic article surveillance marker that has a magnetostrictive resonator made of an amorphous magnetic material. The resonator is sufficiently elongated to have a longitudinal axis. A pair of bias magnets, also each having a longitudinal axis, are disposed on opposite sides and adjacent the resonator to bias the resonator with a magnetic field of a preselected field strength. The pair of bias magnets and the resonator can be relatively equal in length, and are positioned in a housing and maintained substantially parallel and coplanar with each other.

The bias magnets are magnetized along their lengths each having a north and a south magnetic pole disposed at opposite ends of each of the bias magnets. The bias magnets are disposed adjacent the resonator so the north pole and the south pole of each bias magnet are adjacent each other and adjacent opposite ends of the resonator.

In one embodiment, the bias magnets are about 6 mils thick by about 3-mm wide by about 3.7-cm long with a separation between the pair of bias magnets of about 1.15-cm. The resonator disposed between the bias magnets is then about 1 mil thick by about 6-mm wide by about 3.8-cm long. Multiple resonators can be disposed between the bias magnets in an alternate embodiment.

In one embodiment, the preselected bias magnetic field strength is about 6.5 Orested (Oe) and the resonator is adapted to resonate at a frequency of about 58 kHz. The bias magnets can be made of a semihard or hard magnetic material.

The bias magnets disposed within the housing can be adjustable in position relative to the resonator, which changes the bias spacing to compensate for measurable variances in preselected magnetic properties of the amorphous magnetic material and the bias magnets, and/or to adjust the resonant frequency of the marker. The housing can include a first cavity sized to capture the resonator so that said resonator is free to resonate, and a second and a third cavity on opposite sides of the first cavity to retain one each of the bias magnets in a preselected position. Alternately, the housing may have one cavity or another configuration so that the resonator is free to vibrate and the bias magnets are maintained in a preselected position.

In an alternate embodiment, the lengths of the bias magnets relative to the resonator can be varied to compensate for measurable variances in preselected magnetic properties of the amorphous magnetic material and the bias magnets, and/or to adjust the resonant frequency of the marker.

Objectives, advantages, and applications of the present invention will be made apparent by the following detailed description of the preferred embodiments of the invention.

DETAILED DESCRIPTION OF THE INVENTION

Figure 1:
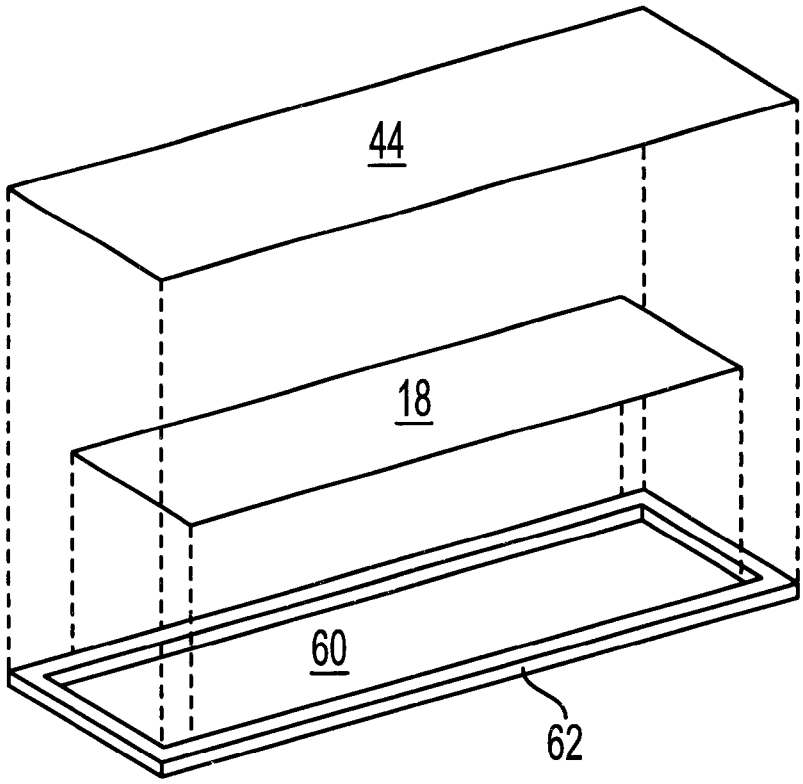
FIG. 1 (PRIOR ART)
FIGS. 1 through 5 illustrate prior art EAS markers.
Figure 2:
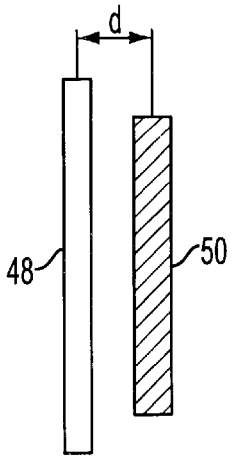
FIG. 2 (PRIOR ART)
Figure 3:
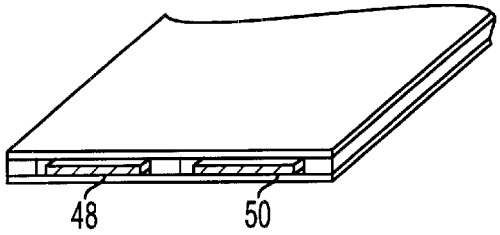
FIG. 3 (PRIOR ART)
Figure 4:
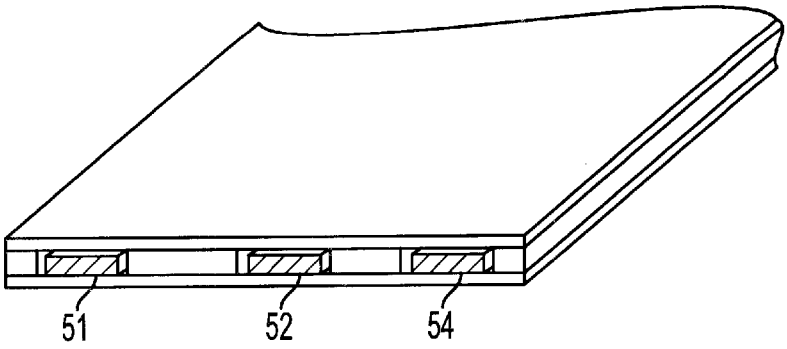
FIG. 4 (PRIOR ART)
Figure 5:
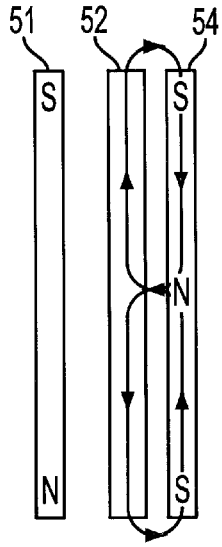
FIG. 5 (PRIOR ART)
Figure 6:
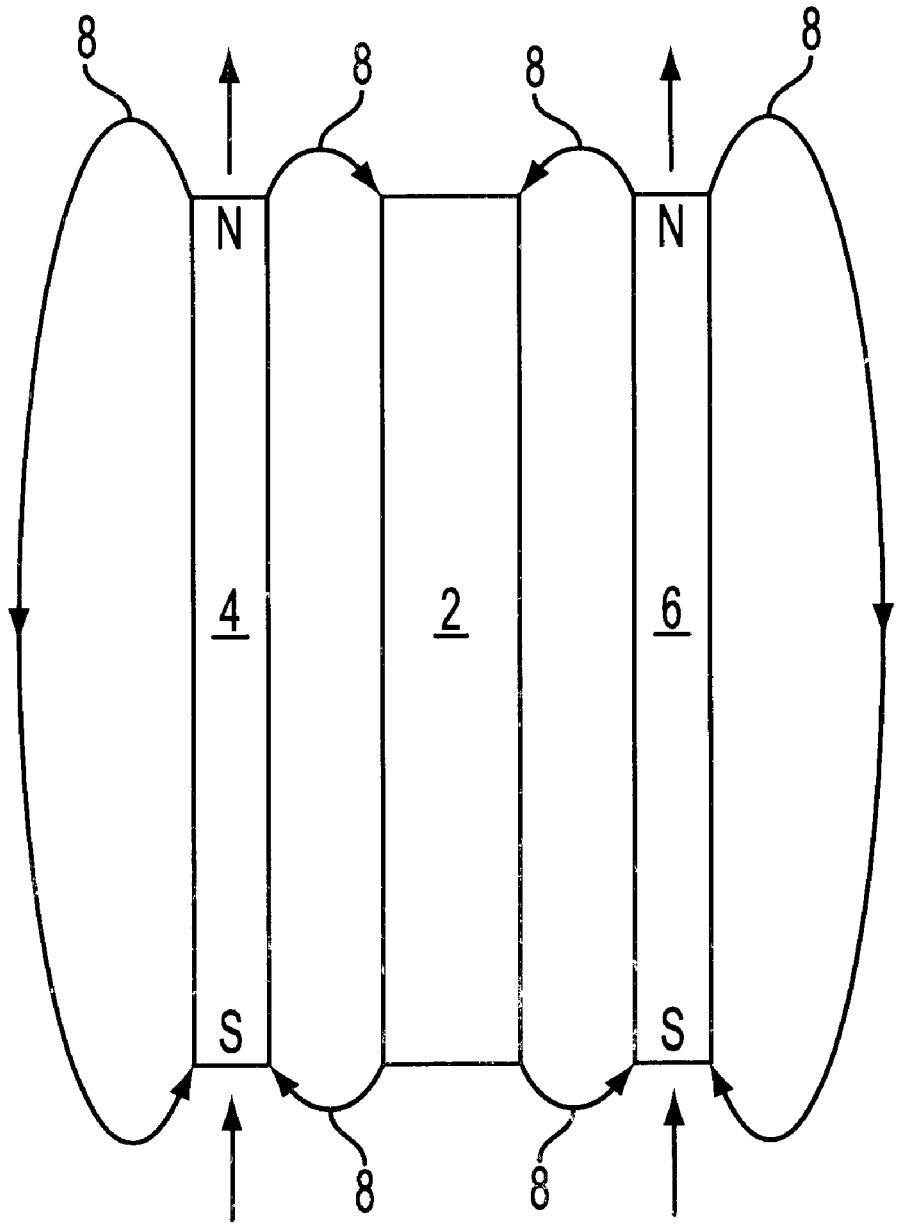
FIG. 6 is a top plan view of the relative positions of the resonator and dual biases of the present invention.

Referring to FIG. 6, resonator 2, made of a magnetostrictive ferromagnetic material, is illustrated disposed between dual ferromagnetic bias magnets 4 and 6. Magnetic north and south poles, disposed at the ends of bias magnets 4 and 6, are maintained adjacent each other forming a DC magnetic field in which lines of magnetic flux 8 pass substantially longitudinally through resonator 2, as illustrated. Because there is a bias magnet (4 and 6) on either side of resonator 2, magnetic attraction is balanced between the resonator 2 and each of the bias magnets 4 and 6, thereby reducing magnetic clamping and resulting in higher resonant output levels. The bias magnets 4 and 6 are illustrated as being substantially equal in length to resonator 2. However, bias magnets 4 and 6 can vary in length relative to resonator 2 as long as the lines of magnetic flux 8 pass substantially longitudinally through resonator 2. The lengths of bias magnets 4 and 6 are thus said to be relatively equal in length to resonator 2.

Figure 7:
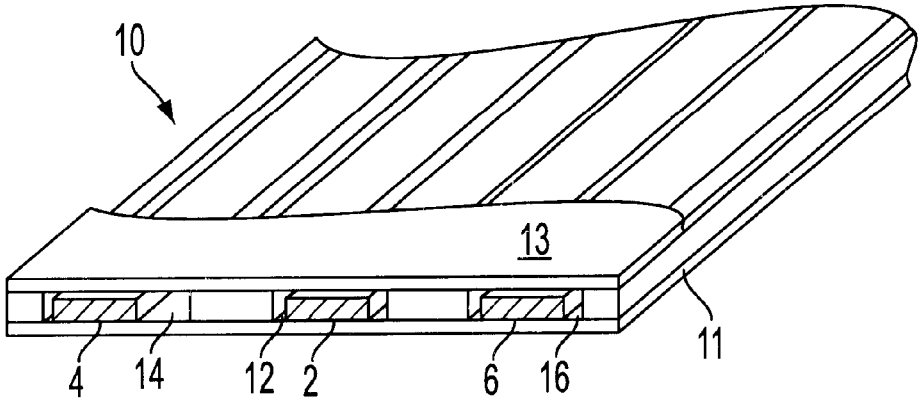
FIG. 7 is a fragmentary perspective view, partially cutaway, of one embodiment of the present invention.

Referring to FIG. 7, one embodiment for an EAS marker 10 made in accordance with the present invention is illustrated. Cavity 12 is sized to permit free vibration of resonator 2. Resonator 2 is flat, without the curl required in resonators of prior markers, and thus cavity 12 can be formed with a shallower depth and still permit free vibration of resonator 2. Cavity 12 can have a height as low as about 10 mils and still allow free movement of one or more 1-mil thick resonators 2. Cavities 14 and 16 are sized to permit some adjustment in spacing of bias magnets 4 and 6, respectively, in relation to resonator 2. The magnetic effect of the lateral adjustment of bias magnets 4 and 6 is filly described hereinbelow. Once positioned in cavities 14 and 16, bias magnets 4 and 6, respectively, are fixed in position by known methods such as glue, heat sealing, mechanical spacers, and the like. Resonator 2 and biases 4 and 6 are retained parallel and substantially in the same plane with each other to produce a relatively thin, flat marker. The outer surface of covers 13 and 11 can be used to apply an adhesive or attach or imprint indicia such as bar code, decorative or concealment patterns, or other applications for use on a flat surface. The materials used to form EAS marker 10, which houses resonator 2 and bias magnets 4 and 6, are conventional materials as known in the art. Alternate embodiments of the present invention are illustrated hereinbelow.

Figure 8:
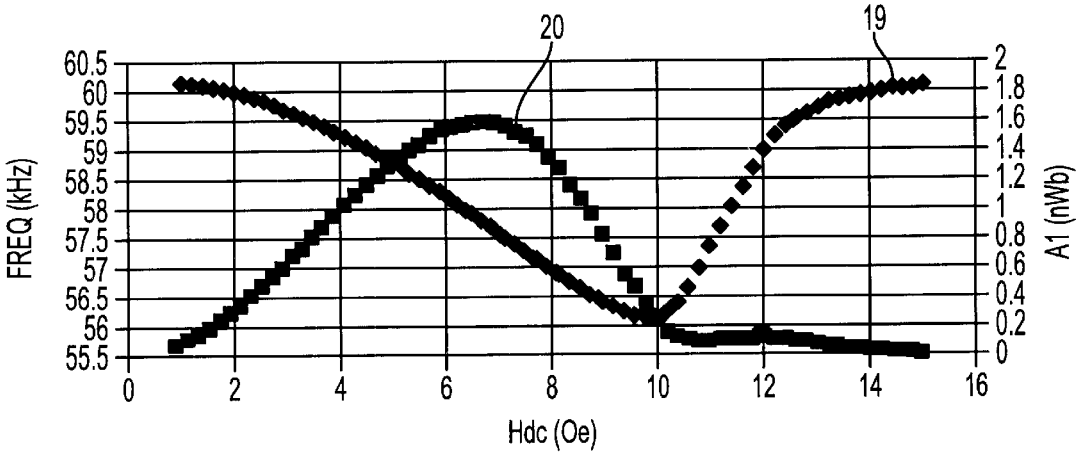
FIG. 8 is a plot of the resonant response of a 6 mm, flat resonator.

Referring to FIG. 8, the resonant behavior of a flat, transverse annealed sample resonator 2 is illustrated in which the resonator is adapted to resonate at about 58 kHz in a 6.5 Oe DC magnetic biasing field. The resonator 2 is about 6-mm wide, about 1 mil thick and about 3.7 cm long. The resonant frequency 19 and resonant signal amplitude 20 are both dependent upon the magnitude of the DC magnetic bias field Hdc (Oe). The signal amplitude (A1) is measured with the unit of nanoweber (nWb), at 1 millisecond after a transmitted burst of 1.6 millisecond AC excitation field at the resonant frequency. At zero DC magnetic field, there is very low resonant output with a resonant frequency near 60.1 kHz. As the DC magnetic field increases, the output of the resonator increases, while its resonant frequency decreases. The signal output (20) has a maximum at about 6.5 Oe, where it resonates at around 58 kHz (19). This is the desired bias point, about 6.5 Oe, which will produce the maximum output. The invention is not limited to this selected example having a resonant frequency of 58 kHz and a bias field of 6.5 Oe. Alternate embodiments, which vary from this example in frequency, bias field strength, and physical dimensions, are contemplated herein.

In an actual marker environment, two strips of hard or semihard magnetic material is used for bias magnets 4 and 6 to provide the required DC magnetic field for the above performance. Hard magnetic material with coercivity (Hc) exceeding 3500 kOe is currently used for re-usable hard tag applications. Whereas, semihard magnetic material, (Hc<30 Oe) is currently used in label applications where activation and deactivation are required. In one embodiment, the two bias strips 4 and 6 are each about 6 mils thick, with dimensions of about 3 mm wide by about 3.7 cm long with a separation of about 1.15-cm. The length of bias strips 4 and 6 can be in the range of about 3-cm to 4-cm, or even longer, with about 3.7 cm being the preferred length for use with a resonator 2 of about 3.7-cm length. The invention is not to be limited to this example as alternate physical dimensions are contemplated herein. The bias magnet strips 4 and 6 are magnetized along their length, to create south poles on one end, and north poles on the other end, as described above. The two bias strips 4 and 6 produce a substantially longitudinal magnetic field component through resonator 2, as illustrated by magnetic flux 8 in FIG. 6. The bias magnets 4 and 6 are on both sides of the magnetic resonator 2 balancing the magnetic attraction force to resonator 2, which prevents magnetic clamping of resonator 2. The bias magnetic field is stable for any positions of resonator 2 between bias magnets 4 and 6 so that bias field instability or positional sensitivity of resonator 2 is no longer a problem. Using two bias magnets 4 and 6 instead of one bias magnet reduces bias instability due to the higher demagnetizing effect of a large single bias that is required to generate the same level of bias field that is generated from bias magnets 4 and 6. As a result, the amplitude of a marker made in accordance with the invention is comparable to a marker having a uniform bias magnetic field that can be generated by a solenoid.

Figure 9:
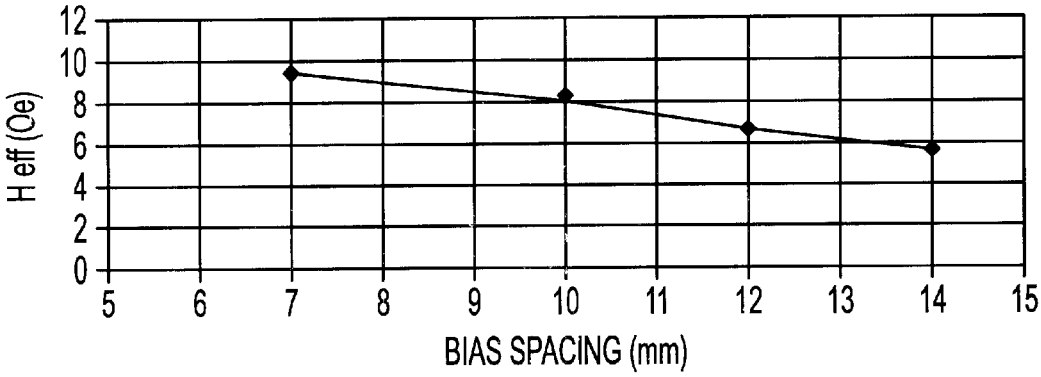
FIG. 9 is a plot of the effect on bias field due to bias spacing.

Referring to FIG. 9, the amount of the magnetic coupling between resonator 2 and biases 4 and 6 is dependent on the spacing between the bias and resonator. Therefore it is possible to compensate for material variability by controlling the positioning of the bias strips 4 and 6 relative to resonator 2. Material variability can effect the strength of the magnetic field produced by the material of the bias magnets, and the effective resonant frequency of the material of the resonator. The effective magnetic field in the marker changes with the bias spacing at a rate of about 0.55 Oe for each millimeter increase in spacing. This translates to about 10% of change in the bias flux variation. As shown in FIG. 9, the effective bias field for this example reduces from about 9 Oe to about 6 Oe, as the spacing increases from 7 mm to 14 mm. As a result, it is possible to fine-tune the bias spacing to compensate for the overall material and processing variability in order to achieve consistent manufacturing quality and performance for a finished marker with preselected performance requirements, and/or to fine-tune the marker's resonant frequency. Referring again to FIG. 7, cavities 14 and 16 are adapted to allow biases 4 and 6, respectively, to move laterally in relation to resonator 2 in order to produce the spacing variation illustrated in FIG. 9. As stated hereinabove, once positioned, the biases 4 and 6 are fixed in place by a suitable method.

Figure 10:
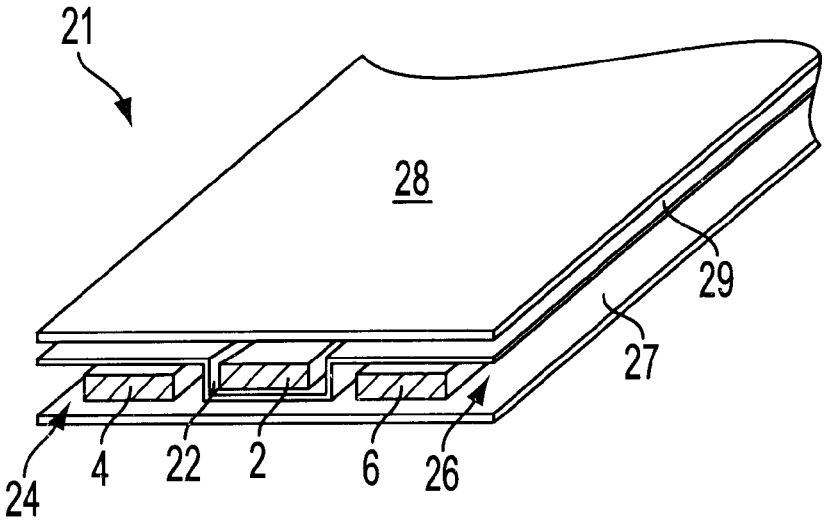
FIG. 10 is an exploded perspective view of one embodiment of the present invention.

Referring to FIG. 10, an alternate embodiment of an EAS marker 21 is illustrated. A single cavity 22 is provided to retain resonator 2. Bias magnets 4 and 6 are placed parallel and adjacent resonator 2 in areas 24 and 26, respectively. Covers 27 and 28 are positioned over and under marker 21 and attached to layer 29 in known manner such as gluing, heat sealing, and the like. The materials of covers 27 and 28 and layer 22 are conventional as known in the art. Cavity 22 is formed by the attachment of layer 29 and cover 28, and areas 24 and 26 are formed by the attachment of cover 24 to layer 29. Cavity 22 is sized to permit resonator 2 to freely vibrate, whereas bias magnets 4 and 6 are fixed in place once they are properly positioned. Bias magnets 4 and 6 can be fixed in place by gluing, heat sealing, and other suitable methods. The exterior surface of covers 27 and 28 can be used to apply an adhesive or attach or imprint indicia such as bar code, decorative or concealment patterns, or other applications for use on a flat surface.

Because a marker made according to the present invention is thin and flat due to the side-by-side resonator 2 and bias (4 and 6) configuration, it was believed to be more tolerant to bending than prior magnetomechanical EAS markers. Bending tests where performed on a marker made in accordance with the present invention and a prior art marker with a transverse curl resonator for direct comparison of the effects of bending.

Figure 11:
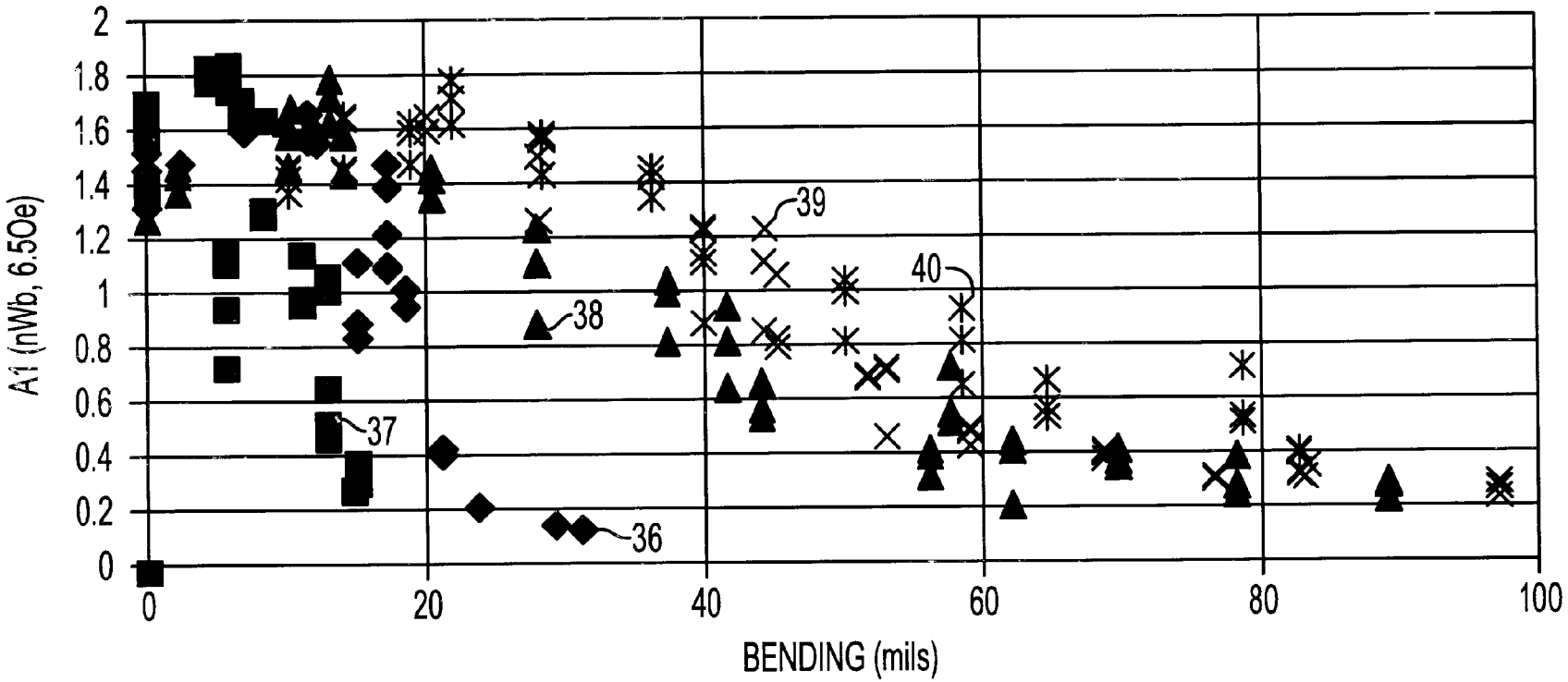
FIG. 11 is a plot of the effects of bending on the present invention in comparison to a prior art marker.
Figure 12:
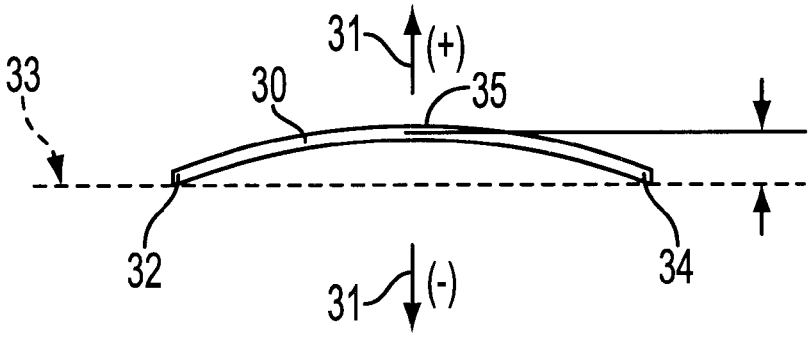
FIG. 12 is a side elevation view of the reference used for a bending test conducted upon the present invention and a prior art label.

Referring to FIG. 11, the results of bending tests are illustrated for one embodiment of the present invention in comparison to a prior art label having a resonator with a transverse curl as shown in the '125 patent. Referring to FIG. 12, the test marker 30 was bent in the (+) or (−)

longitudinal direction 31 while holding ends 32 and 34 fixed in a horizontal reference plane 33, with the bending in mils representing the vertical deflection of center 35 from the horizontal reference 33. A 6-mm wide prior art curl resonator marker was tested with a bend in the (+) direction 36 and a bend in the (−) direction 37. Three samples of a flat marker made in accordance with the present invention were tested 38,39, and 40. Because of the symmetry of the flat marker, bending in the (+) and (−) direction yields the same result and thus only one bending measurement was recorded for each sample 38, 39, and 40. As illustrated, the A1 output, as defined hereinabove, of the curl resonator marker, with bending in either the (+) or (−) direction 36 and 37, quickly diminished as the bending exceeded about 15 mils. In contrast, each of the flat side-by-side markers 38, 39, and 40 did not experience A1 degradation until above about 30 mils of bending. The rate of A1 degradation is also more gradual in the flat markers even with bending of up to 50 mils. In applications that may require marker bending, or in which incidental bending occurs, the flat markers of the present invention will perform better than the prior art markers.

Figure 13:
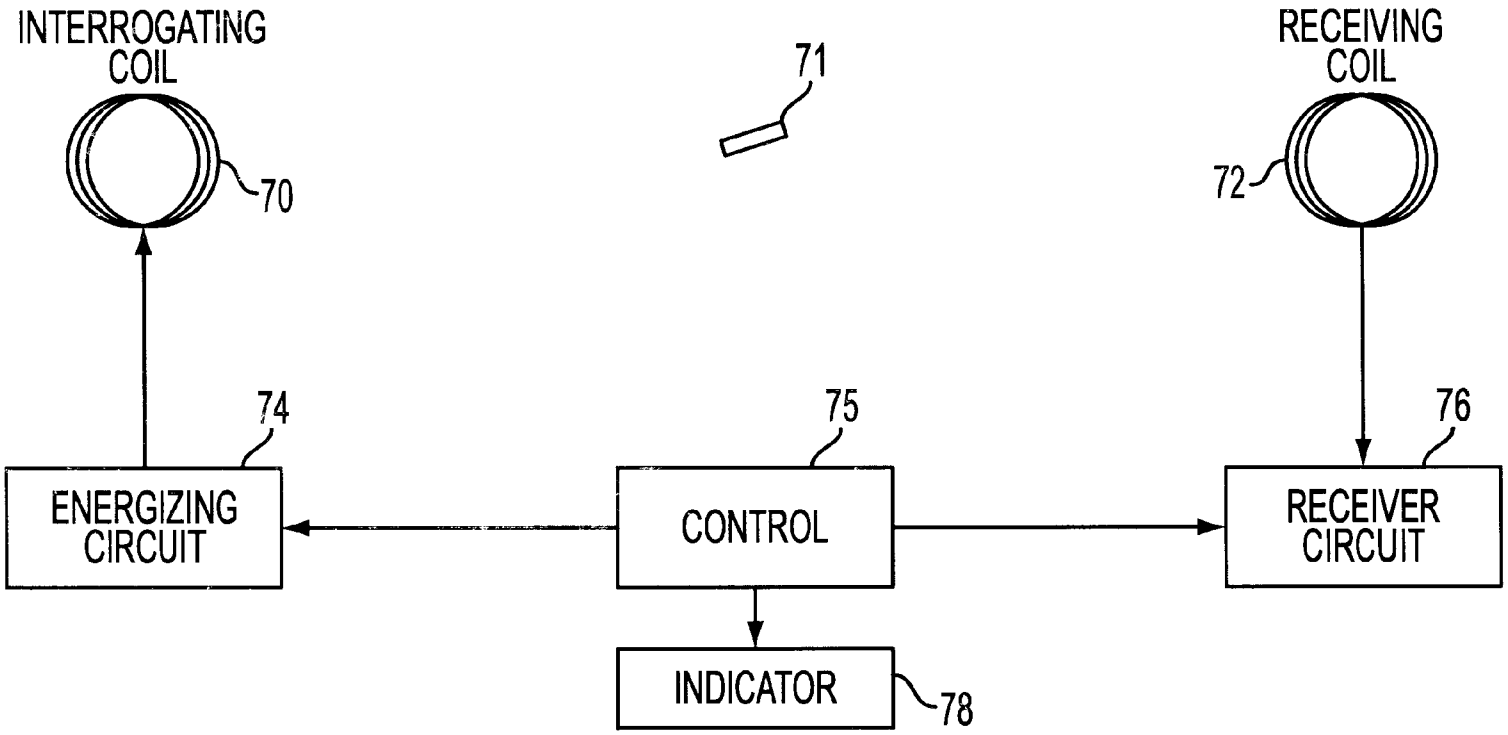
FIG. 13 is a schematic illustration of an EAS system according to the invention.

FIG. 13 schematically illustrates an EAS system using inventive marker 71, which is an EAS marker made in accordance with the present invention, and including interrogating coil 70, receiving coil 72, energizing circuit 74, control circuit 75, receiver circuit 76, and indicator 78. In operation, energizing circuit 74, under control of control circuit 75, generates an interrogation signal and drives interrogating coil 70 to radiate the interrogation signal within an interrogation zone disposed between interrogating coil 70 and receiving coil 72. The receiver circuit 76 via receiving coil 72 receives signals present in the interrogation zone. The receiver circuit 76 conditions the received signals and provides the conditioned signals to the control circuit 75. The control circuit 75 determines, from the conditioned signals, whether an active marker 71 is present in the interrogation zone. If an active EAS marker 71 is in the interrogation zone, the marker 71 will respond to the interrogation signal by generating a marker signal. The marker signal will be received via receiving coil 72 and receiver circuit 76, and be detected by control circuit 75, which will activate indicator 78 to generate an alarm indication that can be audible and/or visual.

Figure 14:
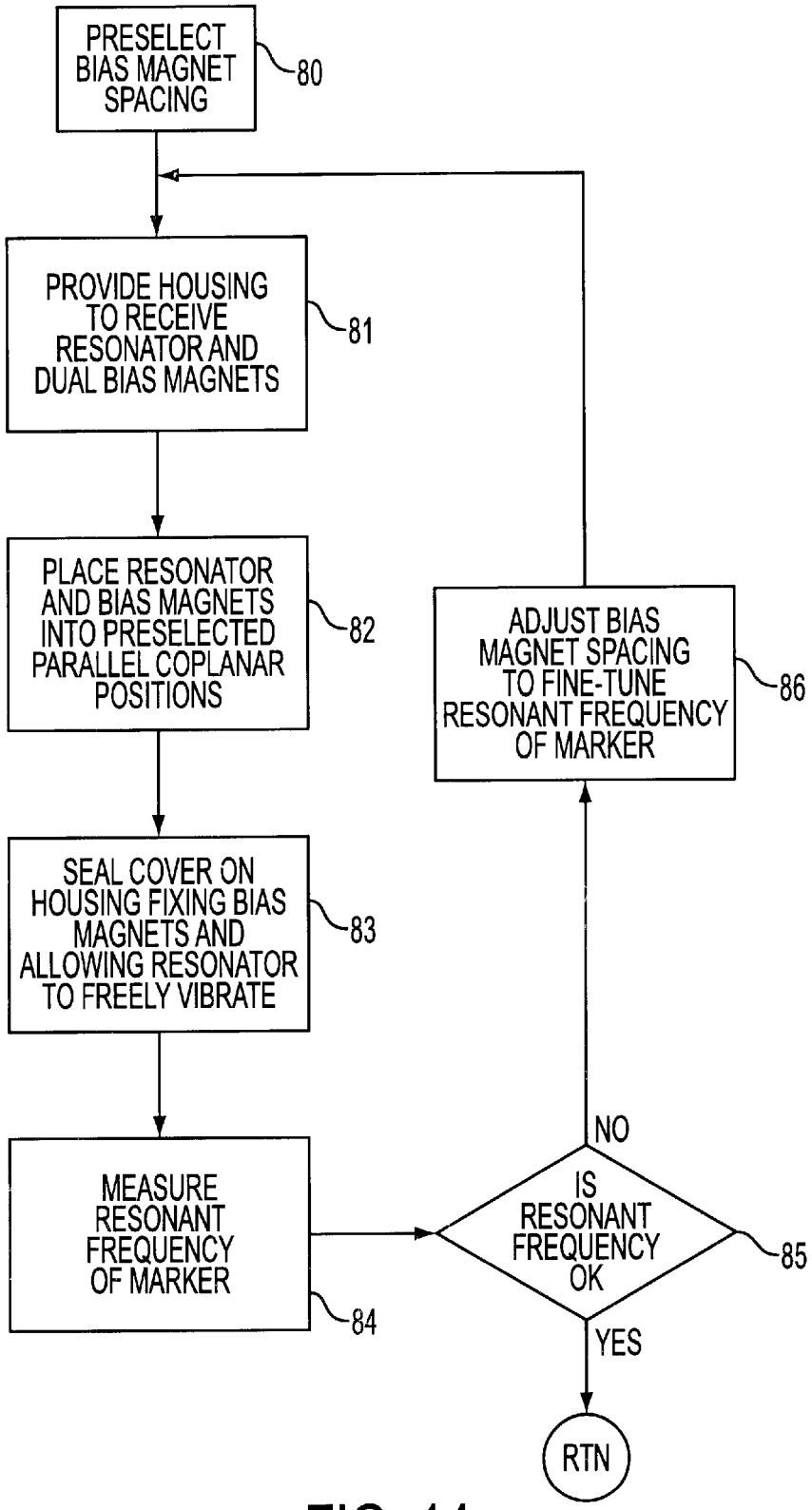
FIG. 14 is a flow chart for assembly of a marker made in accordance with the present invention.

Referring to FIG. 14, a method of assembly of a marker made according to the present invention is illustrated. In step 80, the initial bias magnet spacing is preselected. Next, in step 81, a housing is provided having at least one cavity to receive resonator 2, and will include either two additional cavities or areas, such as shown in FIGS. 7 and 10, respectively, for receiving bias magnets 4 and 6. In step 82, a resonator 2 is placed into its cavity, and bias magnets 4 and 6 are placed within associated cavities or areas as provided by the housing so that they are all substantially in a parallel and coplanar relationship with each other. In step 83, a cover is sealed over resonator 2 and bias magnets 4 and 6. An upper and lower cover may be sealed over the housing as required by the particular embodiment. Resonator 2 must be captured in a manner that permits free vibration whereas bias magnets 4 and 6 are locked or fixed in place so that when the bias magnets 4 and 6 are magnetized, the desired magnetic bias field is maintained on resonator 2. Next, in step 84 the resonant frequency of the resultant marker is measured. If the marker's resonant frequency is not in the desired preselected range (step 85), the bias magnet spacing is adjusted at step 86. Adjusting the bias magnet lateral spacing adjusts the magnetic bias field on the resonator and thus the marker's resonant frequency to adjust for a specific resonance, and to compensate for material variability. The process can then be repeated back to step 81.

Figure 15:
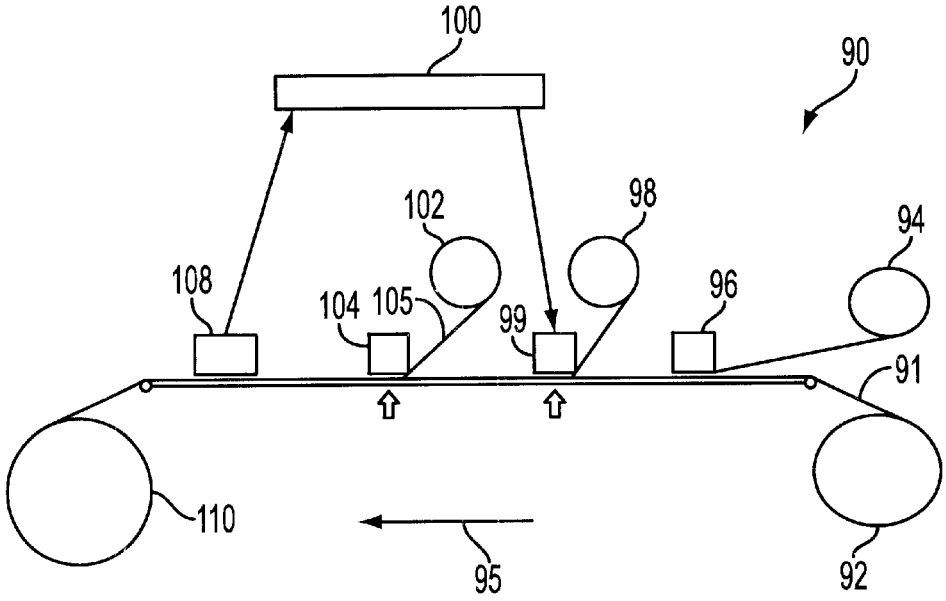
FIG. 15 is a schematic diagram of an apparatus for making a marker according to the method of FIG. 14.
Figure 18:
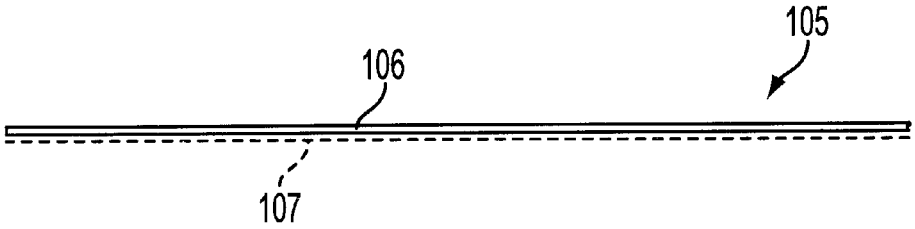
FIG. 18 is a side elevation view of the cover for the marker housing material of FIG. 17.
Figure 17:
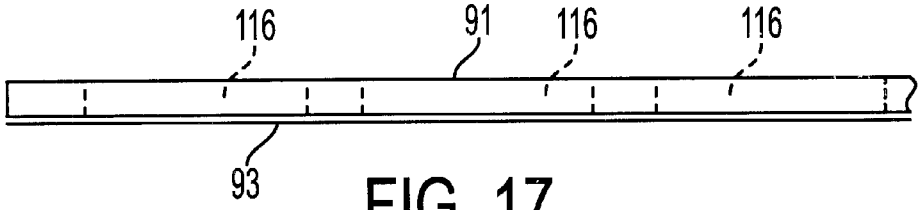
FIG. 17 is side elevation view of that of FIG. 16.
Figure 16:
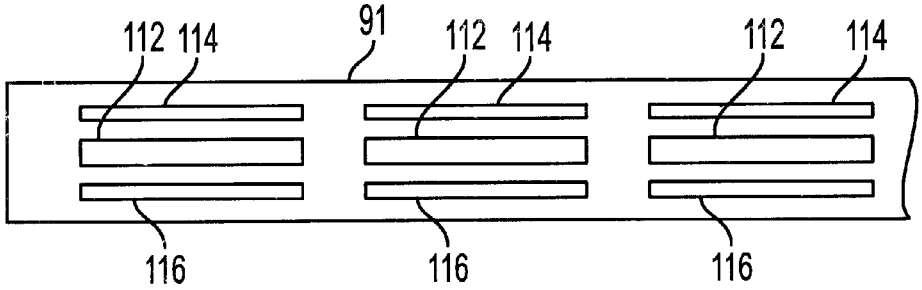
FIG. 16 is a partial top plan view of continuous marker housing material used in the apparatus of FIG. 15.

Referring to FIG. 15, an example apparatus for manufacturing a marker according to the method shown in FIG. 14 is illustrated. Linear marker machine 90 includes bottom layer wheel 92, which is a continuous reel of marker housing material 91 that has been preformed to provide a plurality of marker housings with one or more cavities per marker as described hereinabove. Referring to FIGS. 16 and 17, in this example, a portion of marker housing material 91 includes a continuous series of resonator cavities 112, and bias cavities 114 and 116 as shown. Bottom layer 93, which can be a paper cover, is attached to housing material 91 prior to rolling onto bottom layer wheel 92. Referring back to FIG. 15, linear marker machine 90 operates in a continuous fashion with all wheels feeding material in the direction of arrow 95. Resonator wheel 94 is a continuous reel of resonator material that is fed to resonator cutter 96 where each resonator 2 is cut and dropped into corresponding cavities 112. In certain applications, more than one resonator can be placed into each resonator cavity. Bias wheel 98 is a continuous reel containing dual bias magnet material, which are each positioned and cut by bias cutter and positioner 99. Alternately, bias wheel 98 can include two bias wheels each containing a single roll of bias material that are each fed to bias cutter and positioner 99. Bias cutter and positioner 99 preselects the lateral bias spacing via control input from bias controller 100. Lid wheel 102 contains a continuous roll of cover material 105 that is fed to heat sealer 104. Heat sealer 104 seals the cover 105 to the marker housing material 91. Referring to FIG. 18, cover 105 can be made of a paper top layer 106 and a hot melt layer 107 made of a material that is suitable for heat sealing to housing marker material 91. Heat sealing is the preferred method of sealing, but alternate methods of attachment can be used including gluing or welding. Test station 108 measures the resonant frequency of each marker, and provides feedback to the bias controller 100 for input to cutter and positioner 99 for adjustment of the lateral bias spacing. Bias controller 100 includes manual control, which is used for initial setting of cutter and positioner 99 for initial operation of marker machine 90, and can be used to bypass input from the test station 108 for special marker applications. The continuous run of finished marker assemblies is rolled onto a finished roll 110. The individual markers can be cut separately on another machine (not shown).

Figure 19:
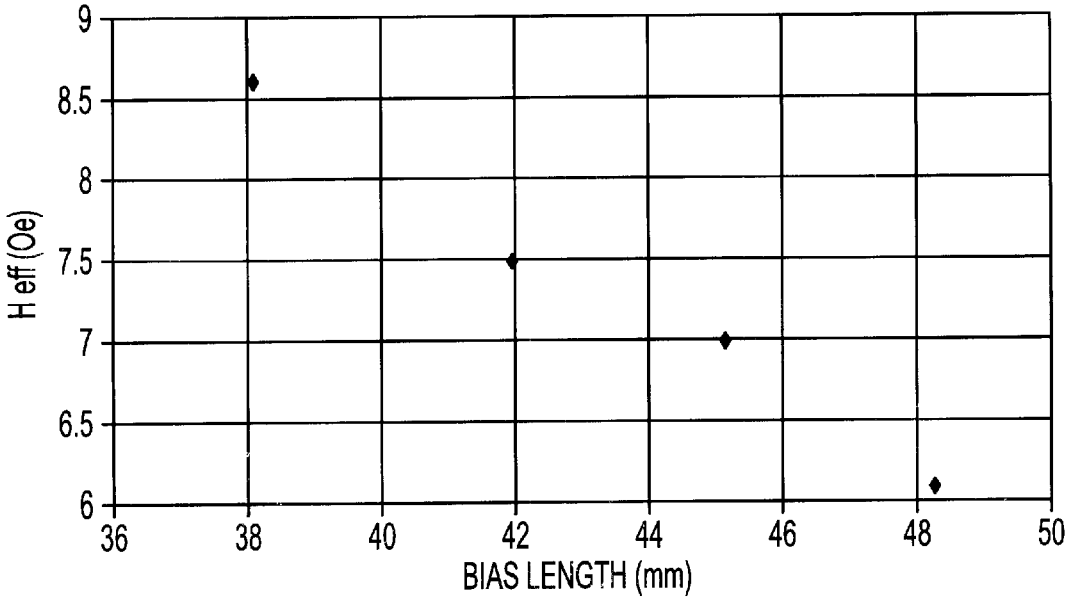
FIG. 19 is a plot of the effect on bias field due to bias length.

Referring to FIG. 19, the effects of the bias magnetic field is illustrated for variation in bias magnet length. Because the bias field varies with the length of the bias magnet, an alternate embodiment of the present invention uses variation in the length of the bias magnets in an analogous manner to adjustment of the bias spacing as described hereinabove. The bias magnet length relative to the resonator is only limited by the proper biasing of the resonator. Proper biasing of the resonator will occur when the lines of magnetic flux 8, shown in FIG. 6, run substantially longitudinally through the length of resonator 2.

Figure 20:
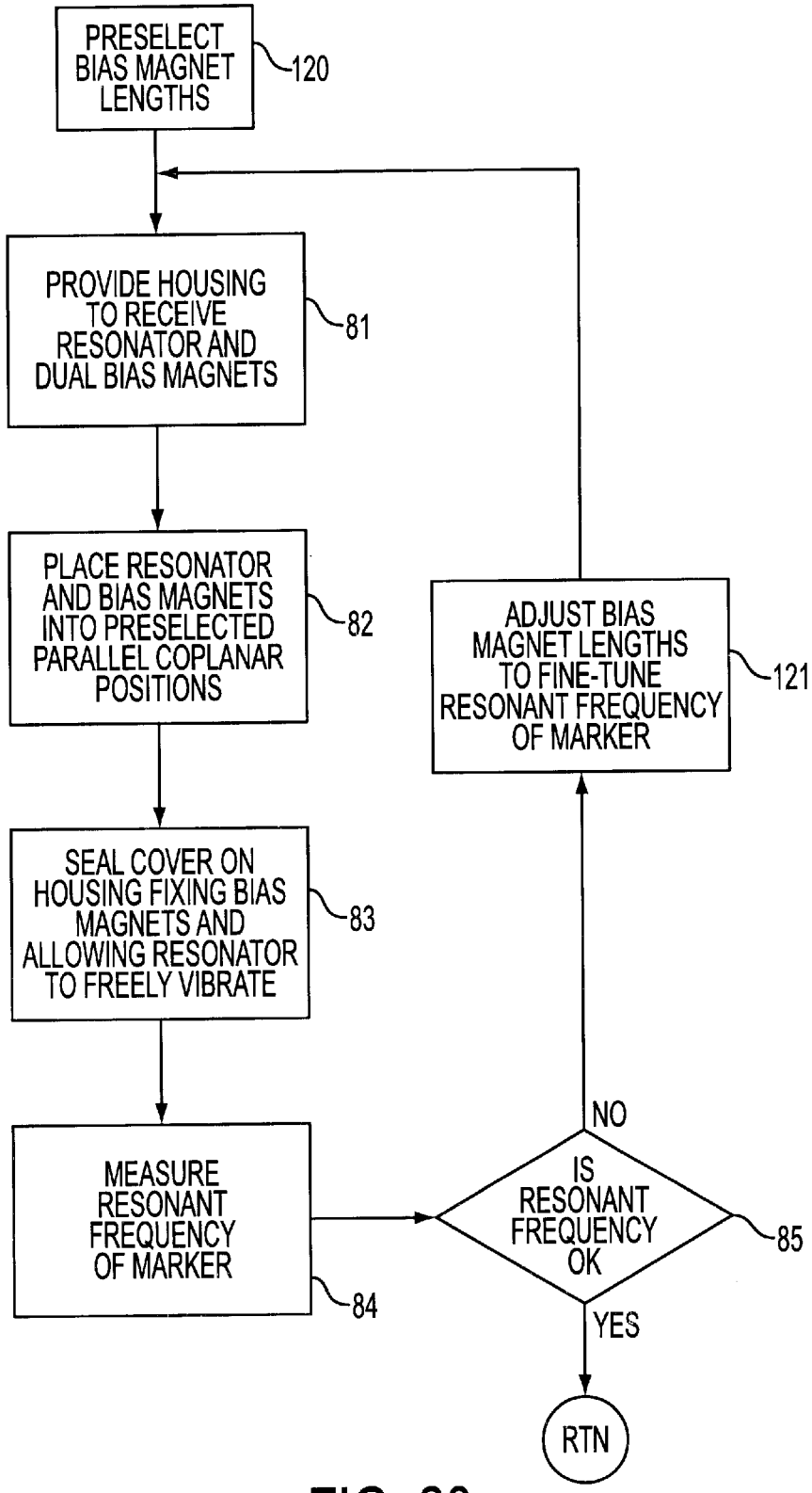
FIG. 20 is a flow chart for assembly of an alternate embodiment of a marker made in accordance with the present invention.

Referring to FIG. 20, a method of assembly of an alternate embodiment of a marker made in accordance with the present invention is illustrated. In this embodiment, the actions that are the same as the actions in the method illustrated in FIG. 14 are given the same reference numerals. In step 120, the initial bias magnet lengths are selected. Steps 81–85 are as described above in the description of FIG. 14, and these descriptions will not be repeated here. If the marker's resonant frequency is not in the desired preselected range (step 85), the bias magnet lengths are adjusted at step 121. Adjusting the bias magnet length adjusts the magnetic bias field on the resonator and thus the marker's resonant frequency to adjust for a specific resonance, and to compensate for material variability. The process can then be repeated back to step 81.

Figure 21:
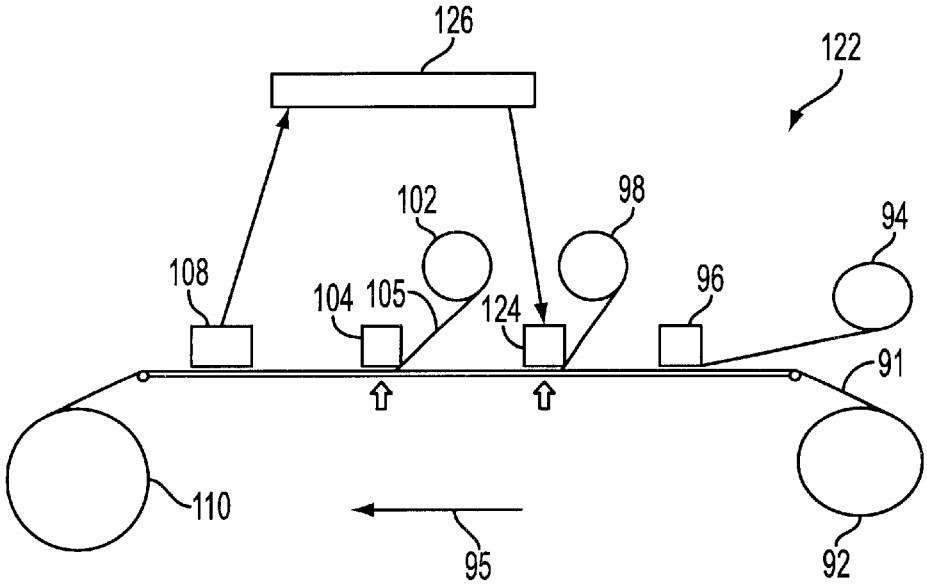
FIG. 21 is a schematic diagram of an apparatus for making a marker according to the method of FIG. 20.

Referring to FIG. 21, an example apparatus for manufacturing a marker according to the marker shown in FIG. 20 is illustrated. Linear marker machine 122 is nearly identical to linear marker machine 90 illustrated in FIG. 15. Members of the apparatus shown in FIG. 21 that are identical to members shown in FIG. 15 are given the same reference numerals. The description of members shown in FIG. 21 that have the same reference numerals as the identical members shown in FIG. 15, will not be repeated here. In this embodiment, the bias spacing is preset. Bias cutter 124 preselects the bias lengths via control input from bias controller 126. Test station 108 measures the resonant frequency of each marker, and provides feedback to the bias controller 126 for input to bias cutter 124 for adjustment of the bias lengths. Bias controller 126 includes manual control, which is used for initial setting of bias cutter 124 for initial operation of marker machine 122, and can be used to bypass input from the test station 108 for special marker applications. The continuous run of finished marker assemblies is rolled onto a finished roll 110. The individual markers can be cut separately on another machine (not shown).

It is to be understood that variations and modifications of the present invention can be made without departing from the scope of the invention. For example, both the bias spacing and the bias lengths could be variable during the manufacturing process. It is also to be understood that the scope of the invention is not to be interpreted as limited to the specific embodiments disclosed herein, but only in accordance with the appended claims when read in light of the forgoing disclosure.

What is claimed is:

1. A magnetomechanical electronic article surveillance marker, comprising:

a magnetostrictive resonator made of an amorphous magnetic material, said resonator having a longitudinal axis;

a pair of bias magnets each having a longitudinal axis, said bias magnets disposed on opposite sides and adjacent said resonator to bias said resonator with a magnetic field of a preselected field strength defined by said pair of bias magnets, said bias magnets and said resonator being relatively equal in length; and, a housing for positioning said resonator and said pair of magnets wherein said longitudinal axis of said resonator and said longitudinal axes of said bias magnets are substantially parallel and coplanar with each other;

wherein said bias magnets are magnetized along their lengths each having a north and a south magnetic pale disposed at opposite ends of each of said bias magnet, said bias magnets disposed adjacent said resonator wherein the north pole and the south pole of each bias magnet are adjacent each other and relatively adjacent opposite ends of said resonator.

2. The marker of claim 1 wherein said bias magnets are about 6 mils thick by about 3-mm wide by about 3.7-cm long with a separation between the pair of bias magnets of about 1.15-cm, and said resonator disposed between said bias magnets being about 1 mil thick by about 6-mm wide by about 3.7-cm long.

3. The marker of claim 2 wherein said preselected bias magnetic field strength is about 6.5 Orested and said resonator is adapted to resonate at a frequency of about 58 kHz.

4. The marker of claim 1 wherein said bias magnets are made of a semihard magnetic material.

5. The marker of claim 1 wherein said bias magnets are made of a hard magnetic material.

6. The marker of claim 1 wherein said bias magnets disposed within said housing are adjustable in position relative to said resonator to compensate for measurable variances in preselected magnetic properties of said amorphous magnetic material and said bias magnets.

7. The marker of claim 6 wherein said housing comprises a cavity sized to capture said resonator so that said resonator is free to resonate, and each of said bias magnets are fixed in a preselected position.

8. The marker of claim 6 wherein said housing comprises a first cavity sized to capture said resonator so that said resonator is free to resonate, and a second and a third cavity on opposite sides of said first cavity to retain one each of said bias magnets in a preselected position within said second and said third cavities, respectively.

9. The marker of claim 1 wherein said bias magnets disposed within said housing are adjustable in length relative to said resonator to compensate for measurable variances in preselected magnetic properties of said amorphous magnetic material and said bias magnets.

10. A method of making a flat magnetomechanical electronic article surveillance marker, comprising the steps of:

providing a housing comprising at least one cavity;

placing a magnetostrictive resonator into said cavity, and placing a first bias magnet and a second bias magnet adjacent said, cavity, said resonator and said bias magnets being substantially parallel and coplanar with each other, and wherein said bias magnets are magnetized along their lengths each having a north and a south magnetic pole disposed at opposite ends of each of said bias magnets, said bias magnets disposed adjacent said resonator wherein the north pole and the south pole of each bias magnet are adjacent each other and relatively adjacent opposite ends of said resonator;

adjusting the lateral position of said first and second bias magnets relative to said resonator to provide a preselected magnetic bias field around said resonator; and, sealing a cover over said cavity wherein said resonator is free to resonate and said first and said second bias magnets are fixed in position.

11. The method of claim 10 wherein the step of sealing a cover includes sealing a second cover over said bias magnets.

12. The method of claim 10 further including the step of adjusting the lengths of said first and second bias magnets relative to said resonator to provide a preselected magnetic bias field around said resonator.

13. A method of making a flat magnetomechanical electronic article surveillance marker, comprising the steps of:

providing a housing comprising a first cavity, a second cavity and a third cavity, said first cavity disposed between said second and third cavities;

placing a magnetostrictive resonator in said first cavity, a first bias magnet in said second cavity, and a second bias magnet in said third cavity, said resonator, said first and said second bias magnets being substantially parallel and coplanar with each other, and wherein said bias magnets are magnetized along their lengths each having a north and a south magnetic pole disposed at opposite ends of each of said bias magnets, said bias magnets disposed adjacent said resonator wherein the north pole and the south pole of each bias magnet are adjacent each other and relatively adjacent opposite ends of said resonator;

adjusting the position of said first and second bias magnets within said second and said third cavities, respectively, to provide a preselected magnetic bias field around said resonator; and, sealing a cover over said cavities wherein said resonator is free to resonate and said first and said second bias magnets are fixed in position in said second and cavities, respectively.

14. The method of claim 13 further including the step of adjusting the lengths of said first and second bias magnets to provide a preselected magnetic bias field around said resonator.

15. An article surveillance system responsive to the presence of a marker within a magnetic interrogation field, comprising:

generating means for generating a magnetic field having a preselected frequency, said generating means including an interrogation coil;

a marker securable to an article for passage through said magnetic field, said marker adapted to respond to said magnetic field and comprising a strip of magnetostrictive ferromagnetic material adapted to mechanically resonate at said preselected frequency when biased by a magnetic field defined by a pair of bias magnets disposed adjacent and parallel to said strip of magnetostrictive material, said bias magnets each having a north and a south magnetic pole disposed at opposite ends of each of said bias magnets and relatively adjacent opposite ends of said strip of magnetostrictive material; and, detecting means for detecting said mechanical resonance of said marker at said preselected frequency, said detecting means including a receiving coil.

16. The system of claim 15 further including indicator means responsive to said detecting means for indicating reception of said mechanical resonance of said marker.

* * * * *

UNITED STATES PATENT AND TRADEMARK OFFICE

CERTIFICATE OF CORRECTION

PATENT NO. : 6,426,700 B1
DATED : July 30, 2002
INVENTOR(S) : Lian et al.

It is certified that error appears in the above-identified patent and that said Letters Patent is hereby corrected as shown below:

Column 4,
Line 64, replace “filly” with -- fully --

Column 10,
Line 4, replace “pale” with -- pole --
Line 5, replace “magnet” with -- magnets --

Column 11,
Line 30, insert -- third -- before “cavities”

Signed and Sealed this

Twenty-first Day of January, 2003

JAMES E. ROGAN
*Director of the United States Patent and Trademark Office*